United States Patent [19]

Koebel

[11] 4,221,292

[45] Sep. 9, 1980

[54] METAL COIL SPACER

[76] Inventor: Thomas P. Koebel, 1248 Baythorne, Flossmoor, Ill. 60422

[21] Appl. No.: 18,575

[22] Filed: Mar. 8, 1979

[51] Int. Cl.[3] ..... B65D 19/00; B65D 19/38; B65D 85/62

[52] U.S. Cl. ..... 206/386; 206/391; 206/516; 206/595

[58] Field of Search ..... 206/391, 393, 394, 389, 206/821, 595, 597, 451, 449, 321

[56] References Cited

U.S. PATENT DOCUMENTS

| | | | |
|---|---|---|---|
| 918,998 | 4/1909 | Goodhue | 206/451 |
| 1,922,560 | 8/1933 | Sullivan | 206/597 |
| 3,415,367 | 12/1968 | Lynch | 206/321 |
| 3,842,991 | 10/1974 | Koebel | 206/821 |

*Primary Examiner*—William T. Dixson, Jr.

*Attorney, Agent, or Firm*—McWilliams, Mann & Zummer

[57] ABSTRACT

A spacer for separating coils of steel, or other metal coils commonly stacked vertically in edge-to-edge relationship with the axis of the several coils in general alignment and disposed vertically with the spacer used in plural between the tiers of coils to provide spaces therebetween for the entrance of handling equipment such as the forks on a lift truck. The spacer comprises a single metal strip formed to provide a plurality of load supporting columns defined by reversely bent areas of the strip in the form of corrugations, of either rounded contours, or rectangular shape and all of which in the spacer as a whole, are formed on a radius to provide an automatic positioning of the spacer when dropped onto a coil so that the columns are always disposed vertically and the edges disposed in engagement between adjacent coils.

6 Claims, 5 Drawing Figures

METAL COIL SPACER

BACKGROUND OF THE INVENTION

Heretofore, in handling steel coils, or aluminum coils, or the like, it has been common practice to use wood strips as separators between coils to provide the space required to insert the tine of the fork on a lift truck and where metal spacers were utilized for this purpose they were usually so formed to obtain the required strength for supporting the loads imposed as to be expensive and uneconomical. Typically, coils of this type are stacked on edge with the axis of the coils extending vertically and spacers of some type are arranged at intervals around the edges between the coils. Where wood strips were used the wood had to be of a quality with sufficient hardness to withstand this type of service which, of course, imposed substantial loads on the spacers and was quite rugged. The wood from which the spacers were made was kiln dried and this added to the cost of such spacers. Where metal spacers were used they had to be constructed for the loads imposed and this required forming of the spacer sections to obtain the required strength and resistance to crushing and all of this increased the cost of providing spacers of this type and made them too expensive for average use.

SUMMARY OF THE INVENTION

This invention provides a coil spacer made from metal but which is very simple in design and easily fabricated and which incorporates a plurality of vertical columns for relatively great strength and is made from scrap, or waste metal, which ordinarily accumulates around a metal working shop, or anywhere metal fabricating is performed. Such metal is otherwise unusable and results from the rejection of some fabricated members which are unacceptable for one reason or another. Other scrap metal is obtained from the trimming operations performed in generally all metal shops. By using such metal as the basis for this coil spacer, instead of discarding it on the scrap heap, the cost of the metal from which this spacer is made is avoided completely and thereby reduces the cost of producing the spacer.

This coil spacer is of very simple design and essentially comprises a metal strip bent to form and thereby obtain the built in strength to perform its function. The spacer starts out as a flat metal strip and is then corrugated, or bent to form a plurality of reversely bent sections, which lend columnar strength to the spacer by providing individual columns represented by each reversely bent section and which extend vertically inasmuch as the spacer is disposed on edge in use. The vertical columns represented by the individual corrugations, may be of curvilinear form, or they may be rectangular and both types are formed continuously throughout the length of the metal strip so that each corrugation runs into and adjoins the next adjacent corrugation on each side whereby a maximum number of columns is obtained in a spacer of given length.

Preferably, the raw edges of the spacer are left unformed so that the finished product is adapted to engage edgewise between coils but, if desired, the opposite edges can be formed for a smoother engaging surface by crimping the edges of the metal strip, or bending them back upon the strip, as shown in a modified form of the invention, especially where it may be desired to use the spacers in association with material where it is necessary to avoid marring a smooth surface.

The invention is disclosed as formed on a radius, which adds to the efficiency and convenience of the spacer in use and while this feature may not necessarily be essential to the success of this type of coil spacer it enables the spacer to be placed flat on the surface where it is to be located and will assume this correct position without the necessity for the user to exercise any unusual, or special effort to position the spacer properly—it assumes the correct position almost automatically. The construction of the spacer on this radius becomes an inherent part of the design and adds to the effectiveness of this particular type of coil spacer.

OBJECTS OF THE INVENTION

The primary purpose of this invention is the provision of a metal coil spacer of simple design such as to be economically feasible.

The principal object of the invention is to provide a metal coil spacer formed of simple design having great supporting strength in excess of the primary structure.

An important object of the invention is the provision of a metal coil spacer in the nature of a strip adapted to be used on edge and of bent form to lend strength and reinforcement to the strip.

Another object of the invention is to provide a metal strip coil spacer of curvilinear form having columnar reinforcements to strengthen the spacer.

A further object of the invention is the provision of a metal strip coil spacer continuously corrugated to provide a plurality of reinforcing columns extending vertically when the spacer is used edgewise.

A still further object of the invention is to provide a metal strip coil spacer having a plurality of adjoining corrugations of curved form providing vertical columns when the spacer is used edgewise.

Another object of the invention is the provision of a metal strip coil spacer having a plurality of adjoining corrugations of rectangular form providing vertical columns in the edgewise position of the spacer in use.

Still another object of the invention is to provide a metal strip coil spacer of corrugated form with the corrugations extending continuously in adjoining relation for the length of the strip and disposed vertically in the edgewise position of the strip.

Another object of the invention is the provision of a metal strip coil spacer incorporating continuously adjoining corrugations with the spacer constructed on a radius.

DESCRIPTION OF THE DRAWINGS

The foregoing and other more specific objects of the invention are attained by the metal strip coil spacer structure and arrangement illustrated in the accompanying drawings wherein.

DESCRIPTION OF PREFERRED EMBODIMENT

Figure 1:
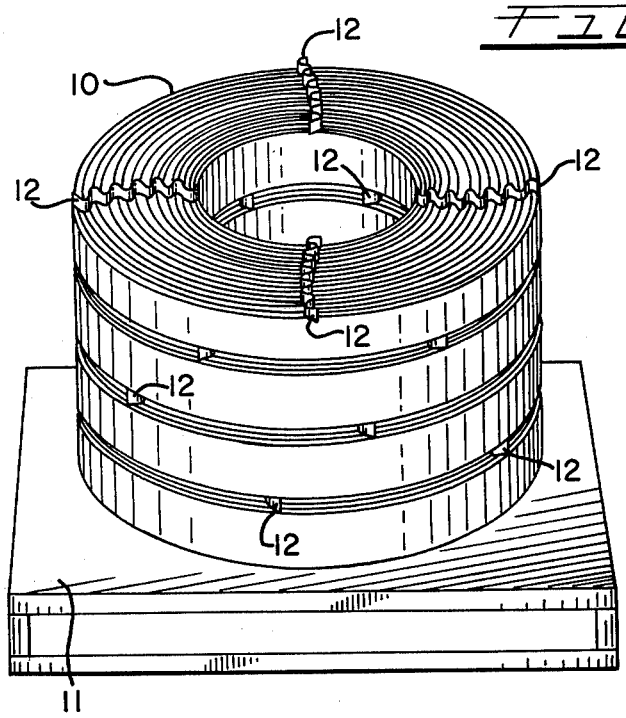
FIG. 1 is a general perspective view of a stack of metal coils supported on a pallet and with the individual coils separated by spacers of the present type with such spacers equally spaced around the top coil for clarity.

As shown in the drawings, looking particularly at FIG. 1, the coils 10 are stacked vertically one on top of another and the entire stack is disposed on a pallet or skid 11 by means of which the stack of coils may be transported by a forklift truck, or the like (not shown). The coils 10 may be steel, or aluminum, or the like and are stacked on edge in vertical alignment with their axes disposed vertically and the several coils are separated by spacers 12 disposed at more or less regularly spaced intervals around the coils. The weight of each of these coils may run in the range of approximately one thousand pounds to approximately two thousand pounds, so that the spacers 12, especially those near the bottom of the stack, are subjected to considerable weight and must be designed to take this load without damage to the edges of the coiled steel, since damage to those edges may necessitate the rejection of the steel coil for fabrication of certain products. As best shown in FIG. 1, it will be seen that the length of each spacer 12 is substantially the same as the dimension of the wound metal on the coil in order to provide support for the coiled metal edges continuously across the area of the wound metal.

Figure 2:
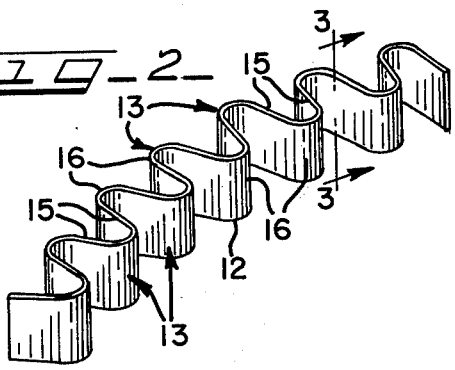
FIG. 2 is a perspective view of the inventive coil spacer showing a continuously corrugated metal strip with the corrugations of curvilinear form.

The spacers 12 are each made from a flat strip of metal and formed to provide a continuous number of corrugations 13, as shown in FIG. 2, which extend vertically of the edgewise disposed strip. The corrugations 13 are of curvilinear form and are disposed in adjoining parallel relationship throughout the length of the metal strip and may be continuously reversely curved, or provided with flat wall sections 15 extending between the curved connecting portions 16. With the spacer arranged edgewise between the coils 10, the corrugations act as a plurality of columns from edge to edge of the strip in supporting the load of the heavy coils and this columnar structure of the coil spacer affords the greatest compressive strength for the spacer to take the great weight of the coils and far in excess of the capacity of the basic strip to take such loads without the benefit of the columnar corrugations. In effect, the corrugations provide a plurality of open columns of generally channel configuration to distribute the metal in the most effective disposition to take the compressive loads imposed by the metal coils. The continuously reverse curvature of the metal strip throughout its length to form the corrugations 13 represents an effective and simple way of increasing the supportive value of the metal strip without prohibitive cost and provides the coil spacer in the most economical way and which has become feasible and acceptable because of its economical advantages as based on its simplified design.

Figure 5:
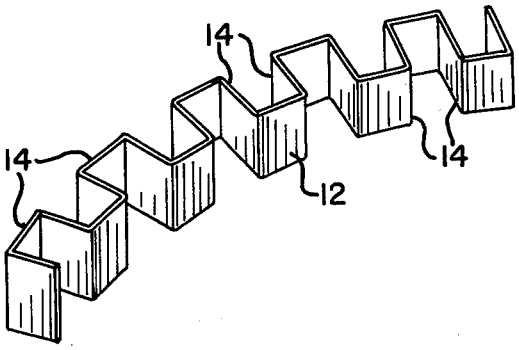
FIG. 5 is a perspective view of the metal strip coil spacer illustrating the spacer formed with continuously disposed corrugations of rectangular form.

In the coil spacer illustrated in FIG. 5 the spacer 12 is also formed with continuously reversely arranged corrugations, but in this arrangement the corrugations 14 are of rectangular configuration having generally parallel walls. Like the spacer of FIG. 2, the corrugations in this form are disposed in adjoining relationship throughout the length of the metal strip from which the spacer is formed, so that when the spacer is disposed in edgewise supporting relationship between coils 10, the individual corrugations each acts as a supporting column to take the heavy load in compression in the most effective manner. This columnar structural arrangement of the rectangular corrugations provides the disposition of the metal in the most effective channel shaped configuration to enable the efficiently shaped columns to take the compressive load of the metal coils 10 in the most effective manner while utilizing a minimum of sectional area in the strip forming the spacer. In this form, the corrugations 14 are truly open channel columns and the continuously reversely bent formation of the plurality of such corrugations affords a maximum number of columns in a coil spacer 12 of given length and in this arrangement too, the compressive strength of the formed spacer is far in excess of that of the basic metal strip to support such loads if such formed columns were not present. The spacer of FIG. 5 is equally as economical of manufacture as the spacer of FIG. 2 and the rectangular corrugations are equally effective in increasing the supportive value of the metal strip in the most economical manner. The coil spacer in either form affords an economical means of providing a metal strip coil spacer of great compressive strength.

As shown in FIGS. 2 and 5, the coil spacer 12 is formed on a radius so that the spacer normally will lie flat in edgewise engagement between the coils 10. This radial curvature has the effect of causing the spacer to assume its edgewise relationship on a metal coil even though it may be just tossed onto the coil or more or less carelessly placed thereon. The radial curved form of the spacer causes a tendency for it to assume the flat position since the general effect of the radial curvature is to increase the overall width of the spacer so that normally it should land and lie flat with the columns 13, or 14, disposed vertically, when placed on a coil in the usually rapid manner generally attendant to such operations.

MODIFIED EMBODIMENTS

Figure 3:
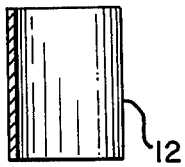
FIG. 3 is a vertical sectional view through a coil spacer taken on the line 3—3 of FIG. 2 showing the flat strip from which the spacer is formed.
Figure 4:
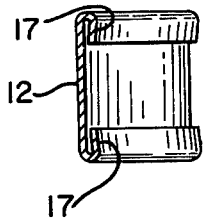
FIG. 4 is a similar sectional view through a spacer showing a modified form of the flat strip section where the opposite edges are bent over to present a smoother edge.

The preferred and generally used cross-sectional shape of the metal strip from which the spacer 12 is formed is usually flat, as best indicated in FIG. 3, but if it should be desired to provide smoother edges on the spacer for use on softer, or smoother metal surfaces, such as on aluminum, the upper and lower edges of the metal strip can be formed to provide wider edges, or smoothly rounded edges, as indicated in FIG. 4. In this form of the strip the upper and lower edges thereof are rebent, or folded back on the strip, as at 17, to provide a reflange that results in a rounded smooth edge of greater thickness, or width, at both the top and bottom edges of the spacer. Thus there will be less likelihood of scratching, or marking, a smooth surface than if the plain edges were retained.

An important advantage of this improved spacer for metal coils is that it is made from metal thus eliminating the need for wooden spacers which not only reduces the expense of acquiring the spacers but has an ultimate beneficial effect upon the environment. The wood spacers are seldom reused inasmuch as they invariably are damaged in use and must be disposed of and the method of disposal involves burning so that a deleterious effect on the environment is the result.

As to the economy effected by the present spacer compared to wood spacers it should be emphasized that whereas wooden spacers may cost approximately four cents each the inventive coil spacer may be obtained at a cost of approximately one half cent each. One reason for this, aside from the advantageous design of the metal spacer, is that when wooden spacers are used they must be of first quality wood, kiln dried and not containing any moisture, or gum, or the like, since any moisture would cause rusting and corrosion of the metal coil edges coming in contact with such spacers.

From the foregoing, it will be seen that a metal coil spacer has been provided that is of the simplest possible form while having maximum supporting strength to stand the heavy loads of coiled strip steel, or other metals and effecting the greatest possible economy as compared to existing spacers.

What is claimed is:

1. A metal spacer comprising a metal strip designed to stand on edge and act as a load bearing support disposed edgewise between stacked loads, said strip being formed to provide a plurality of columnar structures in adjoining relation from end to end of the strip, said columnar structures being disposed in parallel relation and extending vertically in the load supporting position of the metal strip and from edge to edge of the strip.

2. A metal spacer as set forth in claim 1 wherein said columnar structures comprise corrugations of curvilinear form having flat wall sections extending between curved connecting portions.

3. A metal spacer as set forth in claim 1 wherein said columnar structures comprise corrugations of generally channel shaped open sections.

4. A metal spacer as set forth in claim 3 wherein said open sections are of rectangular configuration having generally parallel walls.

5. A metal spacer as set forth in claim 3 wherein said strip is formed with at least one reflange providing at least one edge of double thickness.

6. A metal spacer as set forth in claim 3 wherein said spacer is formed on an overall radius whereby to effectively increase the width of the spacer.

* * * * *